US005409131A

United States Patent [19]

Phillips et al.

[11] Patent Number: 5,409,131

[45] Date of Patent: Apr. 25, 1995

[54] COFFEE LID

[76] Inventors: Tangelia D. Phillips, 8602 Sussex Ave., East Orange, N.J. 07018; George Spector, 233 Broadway Rm 702, New York, N.Y. 10279

[21] Appl. No.: 285,016

[22] Filed: Aug. 2, 1994

[51] Int. Cl.[6] ..... A47G 19/22; B65D 51/16

[52] U.S. Cl. ..... 220/717; 220/361; 220/367; 220/705; 220/714; 215/1 A

[58] Field of Search ..... 220/361, 367, 369, 255, 220/231, 717, 714, 713, 711, 705, 375; 215/1 A, 229; 229/103.1

[56] References Cited

U.S. PATENT DOCUMENTS

| | | | |
|---|---|---|---|
| 2,608,841 | 9/1952 | Rice | 220/717 X |
| 3,201,015 | 8/1965 | Wagaman | 220/705 X |
| 3,434,622 | 3/1969 | Czegledy | 220/231 |
| 4,415,097 | 11/1983 | Meins | 220/711 |
| 4,428,498 | 1/1984 | Obey | 220/367 |
| 4,782,975 | 11/1988 | Coy | 220/711 |
| 5,005,717 | 4/1991 | Oilar | 220/375 X |
| 5,044,512 | 9/1991 | Giancaspro et al. | 220/375 X |
| 5,242,079 | 9/1993 | Stephens et al. | 220/705 |
| 5,310,081 | 5/1994 | McCabe | 220/715 |

*Primary Examiner*—Allan N. Shoap
*Assistant Examiner*—Vanessa Caretto

[57] ABSTRACT

An improved drinking lid for a disposable coffee cup having an open top comprising a dome shaped cover having an air vent hole and conforming to the open top of the coffee cup. A peripheral rim is on the cover to engage in a seating manner, a lip on the open top of the coffee cup. A flexible drinking spout is formed in the cover, to allow coffee in the coffee cup to exit therefrom into a mouth of a person. A structure is for shielding the air vent hole in the cover, when the flexible drinking spout is not being used. An element is for coupling the flexible drinking spout to the shielding structure. When the flexible drinking spout is bent over to be used, the shielding structure will open to expose the air vent hole, to enable the coffee in the cup to better exit the flexible drinking spout.

4 Claims, 1 Drawing Sheet

COFFEE LID

BACKGROUND OF THE INVENTION

The instant invention relates generally to cup covers and more specifically it relates to an improved drinking lid for a disposable coffee cup, which provides a flexible spout which is adjustable for the mouth, to prevent spillage of the coffee.

There are available various conventional cup covers which do not provide the novel improvements of the invention herein disclosed.

SUMMARY OF THE INVENTION

A primary object of the present invention is to provide an improved drinking lid for a disposable coffee cup, that will overcome the shortcomings of the prior art devices.

Another object is to provide an improved drinking lid for a disposable coffee cup that contains a flexible drinking spout formed in the lid which is adjustable, so as to be received by the mouth to prevent spillage of the coffee from within the cup.

An additional object is to provide an improved drinking lid for a disposable coffee cup, in which a flap valve built into the lid is opened by a lanyard connected to the flexible drinking spout, to expose an air vent hole in the lid to enable the coffee to better exist the flexible drinking spout.

A further object is to provide an improved drinking lid for a disposable coffee cup, that is simple and easy to use.

A still further object is to provide an improved drinking lid for a disposable coffee cup, that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
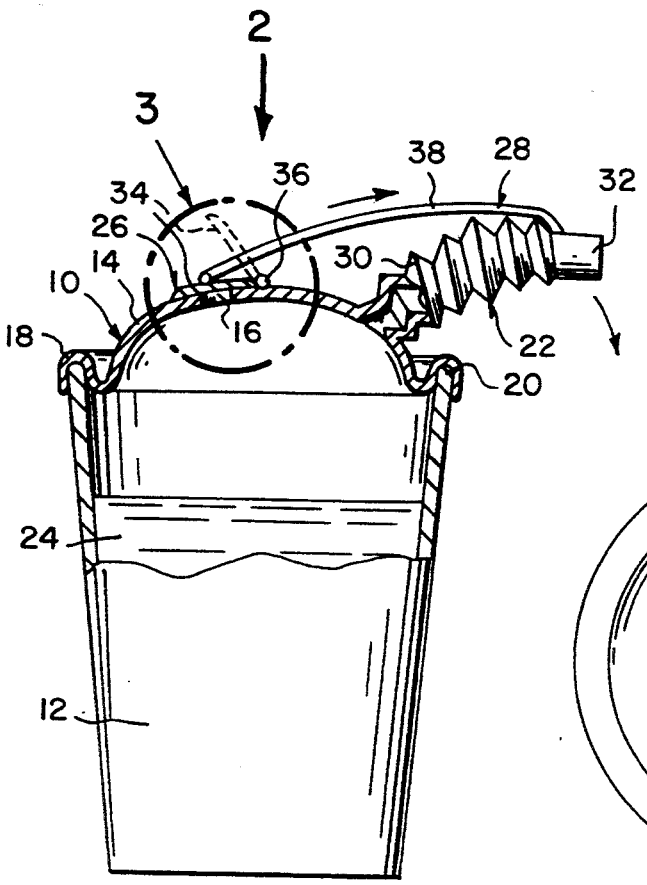
FIG. 1 is an elevational view partly in cross section of the instant invention.
Figure 2:
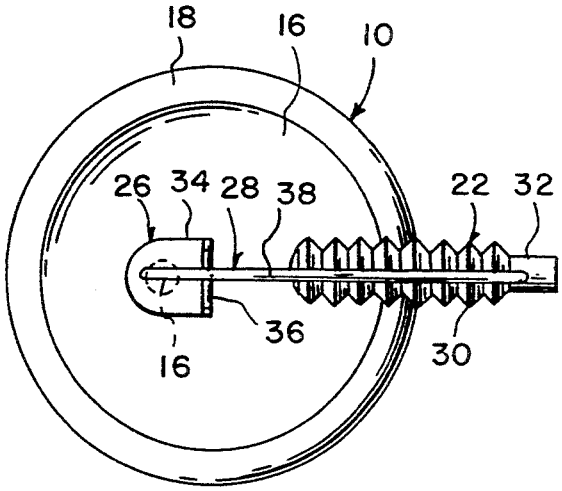
FIG. 2 is a top view taken in the direction of arrow 2 in FIG. 1 of the lid
Figure 3:
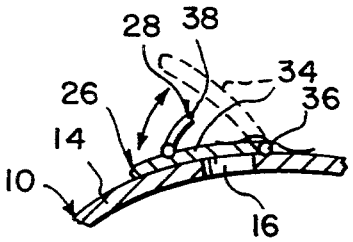
FIG. 3 is an enlarged cross sectional view of the area indicated by arrow 3 in FIG. 1, showing the flap valve in greater detail which is opened by the lanyard connected to the flexible drinking spout, to expose the air vent hole.

Turning now descriptively to the drawings, in which similar reference characters denote similar elements throughout the several views, FIGS. 1 through 3 illustrate an improved drinking lid 10 for a disposable coffee cup 12, having an open top comprising a dome shaped cover 14 having an air vent hole 16 and conforming to the open top of the coffee coup 12. A peripheral rim 18 is on the cover 14, to engage in a seating manner, a lip 20 on the open top of the coffee cup 12. A flexible drinking spout 22 is formed in the cover 14, to allow coffee 24 in the coffee cup 12 to exit therefrom into a mouth of a person.

A structure 26 is for shielding the air vent hole 16 in the cover 14, when the flexible drinking spout 22 is not being used. An element 2 is for coupling the flexible drinking spout 22 to the shielding structure 26. When the flexible drinking spout 22 is bent over to be used, the shielding structure 26 will open to expose the air vent hole 16, to enable the coffee 24 in the cup 12 to better exit the flexible drinking spout 22.

The flexible drinking spout 22 is a corrugated tube 30, having a mouthpiece 32 on its distal end which can bend in any direction. The shielding structure 26 is a flap valve 34 having a spring hinge 36 on the cover 14, to normally keep the flap valve 34 down over the air vent hole 16. The coupling element 28 is a lanyard 38 extending between the mouthpiece 32 on the corrugated tube to the flap valve 34. The lanyard 38 will pull open the flap valve 34, when the corrugated tube 30 is bent over.

OPERATION OF THE INVENTION to use the improved drinking lid 10, a person simply places the peripheral rim 18 on the lip 20 of the cup 12. The flexible drinking spout 22 is then bent over, so that the mouthpiece 32 can engage with a mouth of a person. The lanyard 38 will then pull the flap valve 3 up to expose the air vent hole 16. This will allow the coffee 24 within the cup 12 to better exit therefrom without spilling.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved drinking lid for a disposable coffee cup having an open top comprising:

a) a dome shaped cover having an air vent hole and conforming to the open top of the coffee cup;

b) a peripheral rim on said cover to engage in a seating manner, a lip on the open top of the coffee cup;

c) a flexible drinking spout formed in said cover, to allow coffee in the coffee cup to exit therefrom into a mouth of a person;

d) means for shielding the air vent hole in said cover when said flexible drinking spout is not being used; and e) means for coupling said flexible drinking spout to said shielding means, so that when said flexible drinking spout is bent over to be used, said shielding means will open to expose the air vent hole to enable the coffee in the cup to better exit said flexible drinking spout.

2. An improved drinking lid for a disposable coffee cup as recited in claim 1, wherein said flexible drinking spout is a corrugated tube, having a mouthpiece on its distal end which can bend in any direction.

3. An improved drinking lid for a disposable coffee cup as recited in claim 2, wherein said shielding means is a flap valve having a spring hinge on said cover, to normally keep said flap valve down over the air vent hole.

4. An improved drinking lid for a disposable coffee cup as recited in claim 3, wherein said coupling means is a lanyard extending between said mouthpiece on said corrugated tube to said flap valve, whereby said lanyard will pull open said flap valve when said corrugated tube is bent over.

* * * * *